US005240447A

United States Patent [19]

Capek et al.

[11] Patent Number: 5,240,447

[45] Date of Patent: Aug. 31, 1993

[54] FLAT TENSION MASK FRONT PANEL CRT BULB WITH REDUCED FRONT SEAL AREA STRESS AND METHOD OF MAKING SAME

[75] Inventors: Raymond G. Capek, Elmhurst; Mark T. Fondrk, Villa Park, Siegfried M. Greiner, Crystal Lake; all of Ill.

[73] Assignee: Zenith Electronics Corporation, Glenview, Ill.

[21] Appl. No.: 815,675

[22] Filed: Dec. 31, 1991

[51] Int. Cl.[5] ..... H01J 9/26

[52] U.S. Cl. ..... 445/45; 313/407; 313/408

[58] Field of Search ..... 313/407, 408; 445/30, 445/45

[56] References Cited

U.S. PATENT DOCUMENTS 4,728,854 3/1988 Fendley ..... 313/407
4,745,330 5/1988 Capek et al. ..... 313/407
4,804,881 2/1989 Strauss ..... 313/407
5,053,674 10/1991 Gismondo et al. ..... 313/407
5,086,251 2/1992 Capek et al. ..... 313/407
5,145,437 9/1992 Ondra et al. ..... 445/45
5,162,694 11/1992 Capek et al. ..... 313/407

*Primary Examiner*—Kenneth J. Ramsey
*Attorney, Agent, or Firm*—Roland W. Norris

[57] ABSTRACT

Accelerated thermal upshock rates in the exhaust cycle of a CRT envelope are attained for a tension mask CRT having a shadow mask supporting rail frame affixed to the front panel. The actual corners of the rail frame are chamfered or left open to provide an increased separation distance from the corners of the funnel seal land. Panel fracturing stresses generated in the funnel seal area corners during upshock are thus alleviated allowing for faster CRT throughput during manufacture, without increasing the size of the CRT components.

16 Claims, 4 Drawing Sheets

FLAT TENSION MASK FRONT PANEL CRT BULB WITH REDUCED FRONT SEAL AREA STRESS AND METHOD OF MAKING SAME

BACKGROUND OF THE INVENTION

1. Field of the Invention

The present invention relates generally to CRTs having front panels with tensioned shadow masks affixed thereto by means of panel-mounted mask support structures. More specifically the present invention relates to speeding the exhaust cycle during manufacture of these CRTs.

2. Discussion of the Related Art

As seen in FIG. 1, a known flat tension mask (FTM) CRT envelope 11, as made by the assignee of the present invention, comprises a substantially rectangular flat glass front panel 13 and a substantially conical glass funnel 15 hermetically sealed together. The funnel 15 and panel 13 are joined by application of heat to a cementious material 17, which is a television grade devritrifying solder glass, known in the art as frit, and shown schematically in a cured, or hardened, state 18. Shadow mask support structures, or rails, 14 are affixed to the panel 13 by frit 18 and form a substantially rectangular mask-support frame 12 (FIG. 2) to support a shadow mask 16 welded thereto. Extending from the funnel 15 is a glass neck 19 into which is hermetically sealed an electron gun 21 by fusing the neck glass thereto. The envelope 11 is evacuated through a tube 23 extending through the gun 21 and the tube 23 is sealed, completing an evacuated and operational CRT. Operational components not necessary to a disclosure of the present invention have been omitted but will be understood by the artisan to be present.

In the evacuation procedure, or "exhaust cycle", the envelope 11 is hooked to vacuum plumbing (not shown) and traversed through a lehr, or oven, having sections of successively higher temperatures. The heat is required to drive contaminants inside the bulb e.g. water, into vaporous states so that they may be withdrawn from the envelope by the vacuum apparatus and a sufficient vacuum may be obtained. Heat is applied from the outside of the envelope and, therefore, a thermal gradient between the inside and outside of the envelope is established which stresses the envelope.

If the envelope is heated too rapidly during evacuation, the envelope may crack due to the stresses generated in the envelope. This envelope failure is very costly since the envelope is very nearly a completed cathode ray tube at this stage of its manufacture. In order to avoid catastrophic failure of the envelope the evacuation procedure is slowed so that the envelope is not thermally stressed at a rate higher than it can safely maintain.

In larger sized flat tension mask bulbs which utilize thicker glass in the envelope, especially in the faceplates, the thermal gradients can become more severe, thus aggravating the above-discussed failure rate versus exhaust time conditions. By attaining a desired accelerated upshock rate consistent with a low envelope failure rate and the minimum heating time needed to achieve a hard vacuum in the tube, a faster evacuation cycle with reduced envelope failure would result in manufacturing savings by reducing equipment and energy requirements while resulting in higher yields.

In past disclosures, the assignee hereof has illustrated various rail frame designs having frame corners configured to avoid contact with the funnel due to the proximity of the rail frame and funnel corners; to avoid particle contamination of the screen; and to provide inexpensive rail frames of straight ceramics which are open at the corners to avoid stress interference patterns at the rail ends which may crack the panel during rail attachment thereto.

However, until now, no reference known to the applicants has detailed the interaction of the stiff funnel corner areas with the proximate rail frame corners and suggested ways to alleviate panel stress in this area to provide faster upshock rates during envelope exhaust.

OBJECTS OF THE INVENTION

It is an object of the present invention to address the above-discussed problems by structuring the envelope components so as to reduce the chance of envelope failure and/or to accelerate the envelope evacuation procedure.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DESCRIPTION OF THE PREFERRED EMBODIMENTS

The preferred embodiment will be discussed in relation to a fourteen inch flat tension mask (FTM) cathode ray tube (CRT) with ceramic rails of a design as set forth in U.S. Pat. No. 458,129, Filing Date: Dec. 28, 1989 and a footprint dimension of 0.220 inches; as attached to a pressed glass faceplate of 0.520 inch thickness and a funnel with a seal land thickness of 0.460 inch as may be found on a FTM CRT computer monitor model #1492 sold by Zenith Electronics Corp., the assignee hereof.

Figure 1:
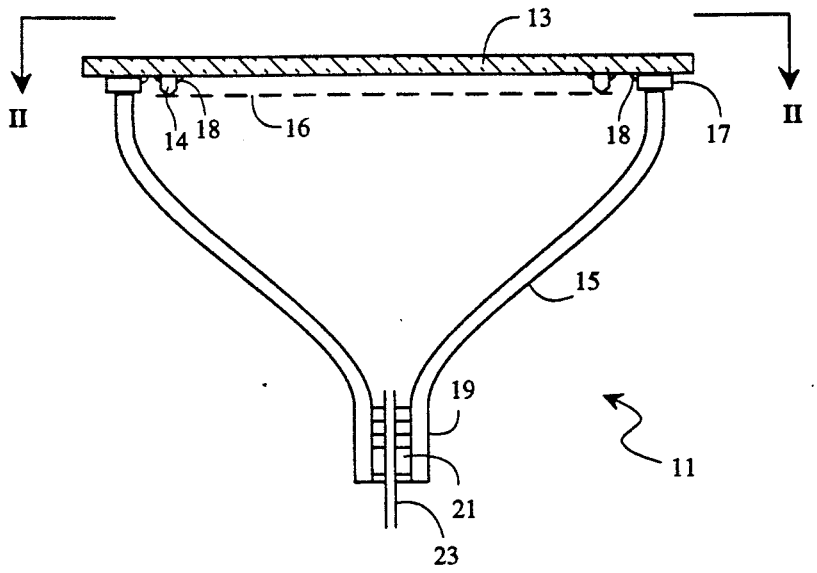
FIG. 1 is a cross section of a tension mask CRT envelope prior to evacuation and sealing.
Figure 2:
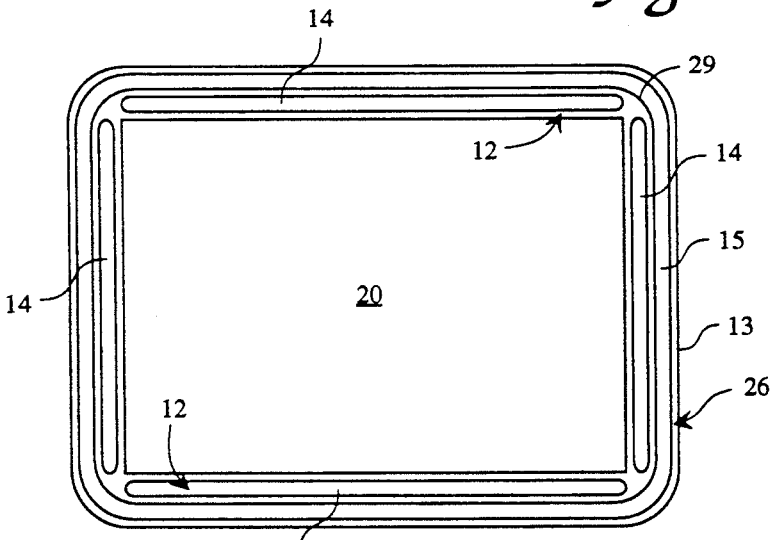
FIG. 2 is a front view of the tension mask CRT of FIG. 1.

As seen in FIG. 2., the funnel 15, when affixed to the panel 13, closely surrounds the mask support structures 14. Such an arrangement gives the largest viewing screen area for the smallest overall envelope size. The mask support structures 14, in turn, closely surround the screen 20. Due to the unique flatness of the panel 13 and the attachment of the rigid mask support structures 14 to the panel, the flat tension mask (FTM) envelope is susceptible to stress-induced failures at the funnel-to-panel seal area, hereinafter funnel seal area 26. Such failures are especially likely at the seal area corners 29, as further explained below.

Figure 3:
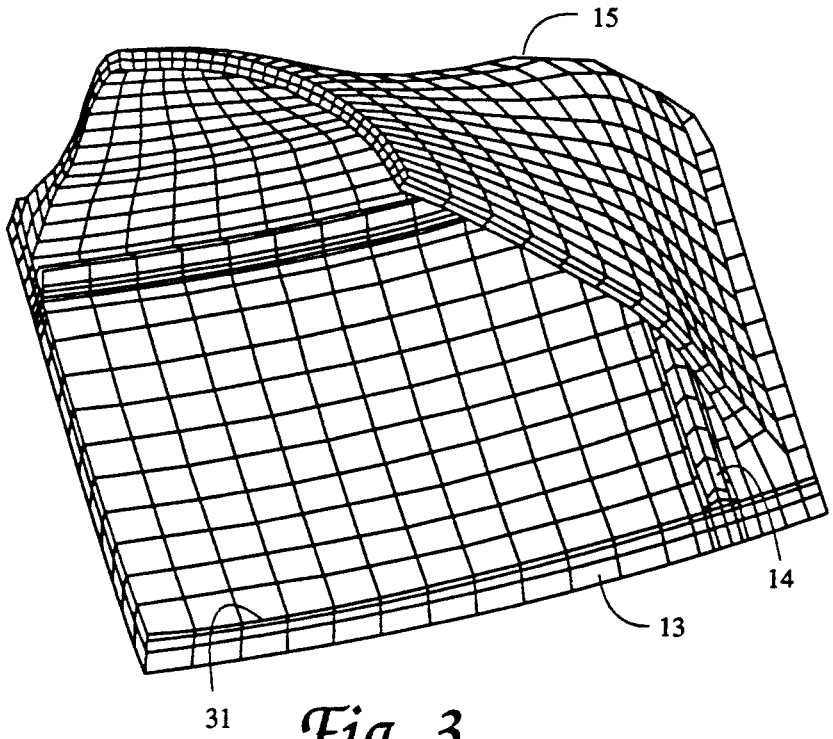
FIG. 3 illustrates the deformation of the CRT envelope corner seal area during exhaust cycle upshock.

During the exhaust cycle "up-shock", i.e. rising temperature phase, the panel stresses are primarily driven by the thermal gradient through the panel. As seen in FIG. 3., this gradient causes the panel 13 to deform spherically. If the panel 13 were unrestrained, this deformation would not be accompanied by high stresses. However, the funnel 15 tries to resist the panel deformation, thereby applying a bending moment to the panel 13. The bending moment produces tensile stresses on the inside surface 31 of the panel. The mask support structures 14 also act to resist panel deformation.

These panel surface stresses are highest in the corners 29, because the funnel 15 is stiffest in the corners 29, thereby presenting the most resistance to panel deformation. Because the funnel 15 is less stiff along the sides, the stresses of the panel inner surface 31 quickly decrease in all directions going away from the corners 29.

The mask supports, or rails 14, also act as stiffeners which resist the deformation of the panel 13. The rail-end frit beads 30 (FIG. 2A) act as stiffeners and stress concentrators that amplify the already high stresses in the panel 13. The location of these stress concentrations coincides with the point where failure initiates during accelerated thermal up-shock.

In the following discussion, a frit bead 18 (FIG. 2B) surrounding each rail 14 and the funnel 15 is a substantially constant width of about 0.050 inches. Because the frit bead dimension is constant, i will not be referred to directly in the following discussion of corner gaps, but will be considered as an integral part of the rail frame and the funnel seal. However, the reader will understand its presence, and the effects thereof, to be inferred, and realize that differing rail and panel dimensions may entail larger frit bead dimensions having wider dimensional tolerances.

Since the stresses at the seal area 26 diminish away from the corners, the stress at the end of the rails can be reduced by moving the rail ends away from the inside corner of the funnel as particularly measured from the internal funnel frit bead. This applies to any type of mask support frame structures attached to the face of the panel. But, the solution of reducing seal area stress by merely increasing the size of the front panel and funnel in relation to a given screen and mask support frame size is not a viable option because of costs and esthetics.

Figure 2A:
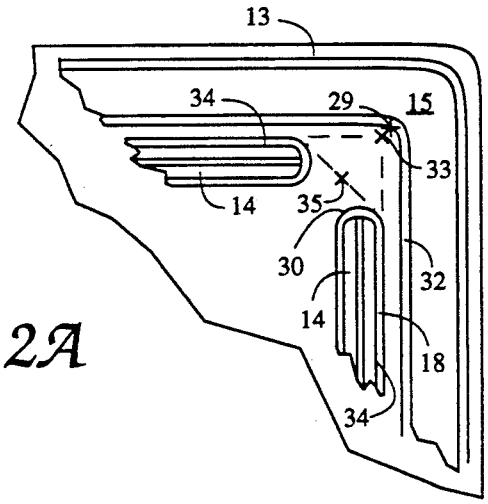
FIG. 2A is a detail of a corner seal area.
Figure 2B:
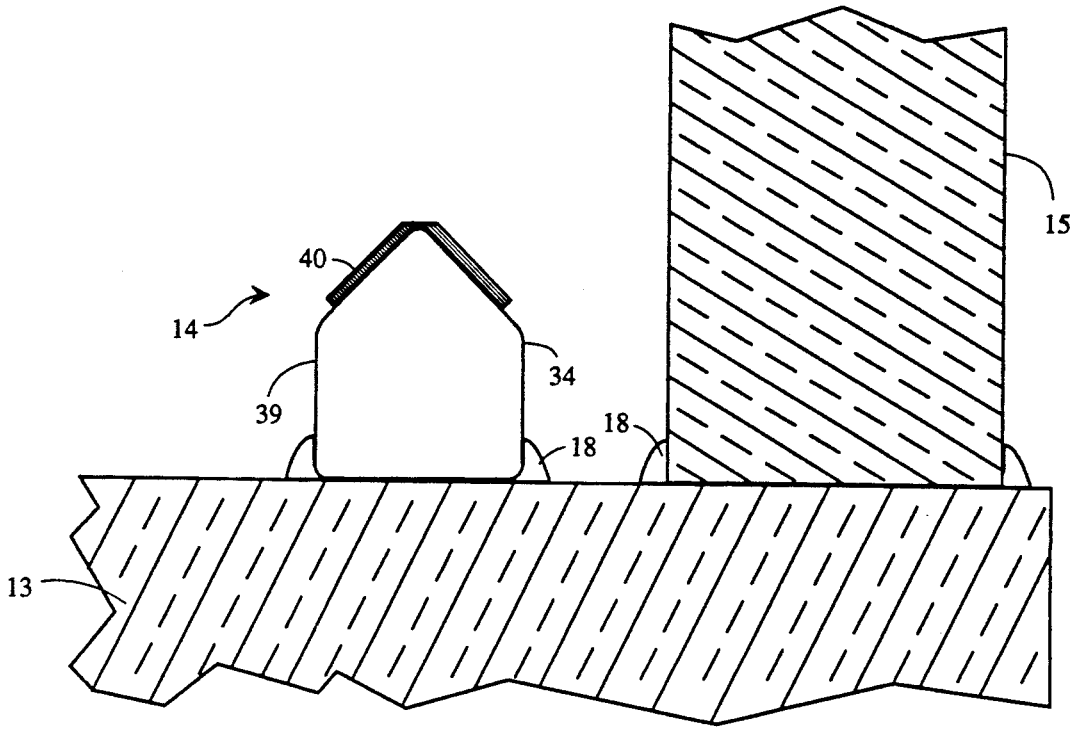
FIG. 2B is an orthogonal view of FIG. 2A.

In the following discussion an "actual corner" 35 will be defined as the center point of a line between the outside edge 34 of adjacent, perpendicular rails, as best seen in FIG. 2A. A "virtual corner" 33 will be defined as the point where the outside edge of the rails 14 would meet if extended into a rail frame with square corners. The "funnel seal corner" 29 is defined as a point on the edge of the interior funnel frit bead on a diagonal through the funnel corner.

Figure 4:
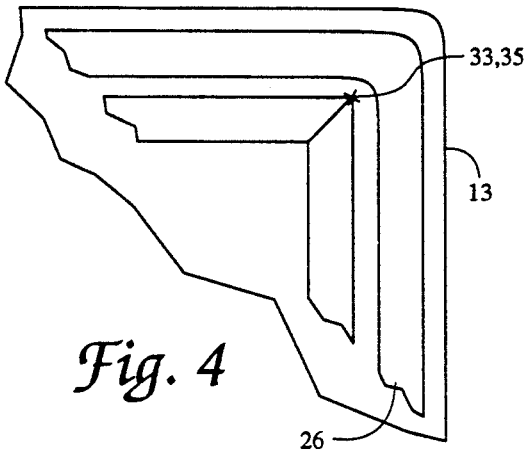
FIG. 4 illustrates a squared corner mask support frame embodiment.
Figure 5:
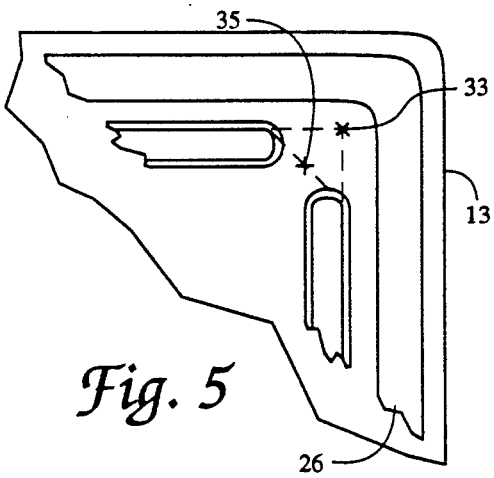
FIG. 5–8 illustrate various mask support frame embodiments according to the present invention which remove the mask support frame actual corner from the mask support frame virtual corner to increase the frame separation distance from the funnel seal corner.

Various rail end embodiments illustrated have been tested to determine their resistance to accelerated thermal upshock during the exhaust cycle. FIG. 4 represents the known square corner mask support frame approach such as shown in U.S. Pat. No. 4,756,702, application Ser. No. 448,212, commonly owned herewith, wherein the virtual corner 33 and the actual corner 35 are the same. FIG. 5 represents a known open-corner mask support frame such as shown in U.S. patent application Ser. No. 458,129, File Date Dec. 28, 1989, commonly owned herewith. The three-eights inch, open-corner gap of FIG. 5 resulted from considerations of overlapping stress fields at the discrete rail ends. Discrete mask support rails were developed to provide an inexpensive ceramic mask support frame, but, too small of a corner gap was found to result in panel spalling and/or cracking during rail affixation to the panel, and therefore the rail ends were withdrawn threeeights inch from the virtual corner to preserve the panel. The present invention, however, deals with the problem of envelope failure during accelerated upshock in the evacuation cycle due to funnel corner/rail frame corner proximity rather than rail-to-rail proximity. This three-eights inch distance represents the minimum pull back for open corner designs and results in a 0.325 inch actual corner to funnel seal spacing. Improved upshock rates may then be had by increasing the rail distance from the virtual corner resulting in greater actual corner to funnel corner frit bead distances.

Figure 6:
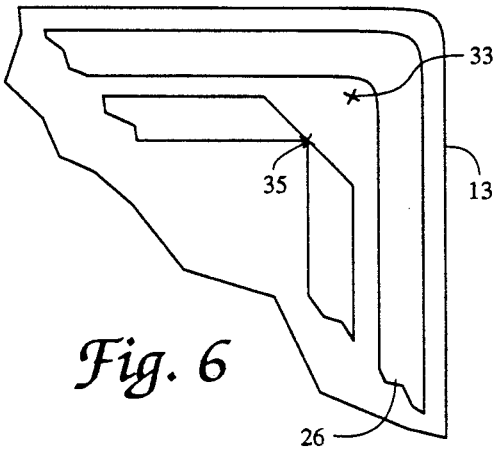
Figure 7:
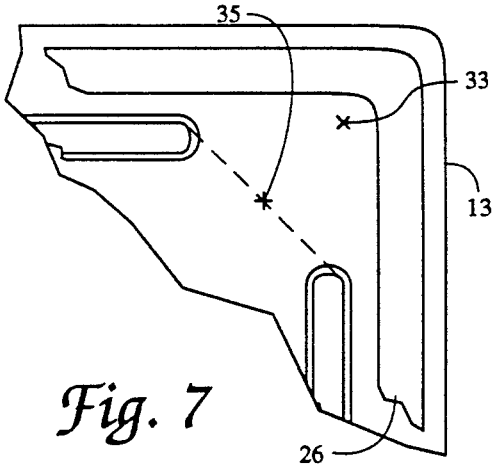
Figure 8:
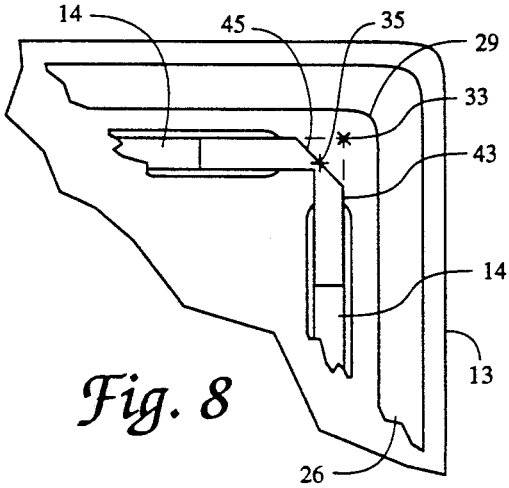

FIGS. 6–8 show various mask support frame corner embodiments which move the stress concentrator points on the frame corners farther from the funnel corner. FIG. 6 is designated as the "chamfered/ closed" corner, which results from sawing abutted rails to increase their corner radius. FIG. 7 is designated as the "one and three-eights inch gap" corner, which results from moving the rails ends one and three eights inch back from the virtual corner 33. One and three eights inch was determined to be substantially the maximum distance needed to withdraw the ceramic substrate portion 39 on the 14 inch CRT to derive maximum effect from the present invention. This gap results in a 1.10 inch actual corner to funnel seal distance. Larger distances yield no further improvement in upshock rates for current envelope design and materials. At a one and three eights inch gap, the metal rail cap, 40 which is typically 0.037 inch thick, (FIG. 2B) should not extend unsupported from the ceramic substrate 39. In order to maintain adequate mask tension for a 14 inch monitor, the rail cap 40 may be formed into a continuous frame as shown in FIG. 2 of U.S. Pat. No. 4,737,681.

FIG. 8 is an alternative to FIG. 6, designated as the "discrete chamfered" corner, which results from a discretely formed corner piece 43 having a chamfered outside edge 45 fitting between the withdrawn straight rails 14 in order to increase the rail frame corner radius and move the stress concentrators away from the funnel corner 29, without creating overlapping stress fields of discrete rails 14, as mentioned above. This embodiment would not require the additional processing step of cutting the rail corners and thus has manufacturing advantages. The need for closed corner rail frame embodiments in relation to particle contamination is discussed in U.S. Pat. #5,053,674 and U.S. patent application Ser. #07/779,684, Filed Oct. 21, 1991, both commonly owned herewith.

Figure 9:
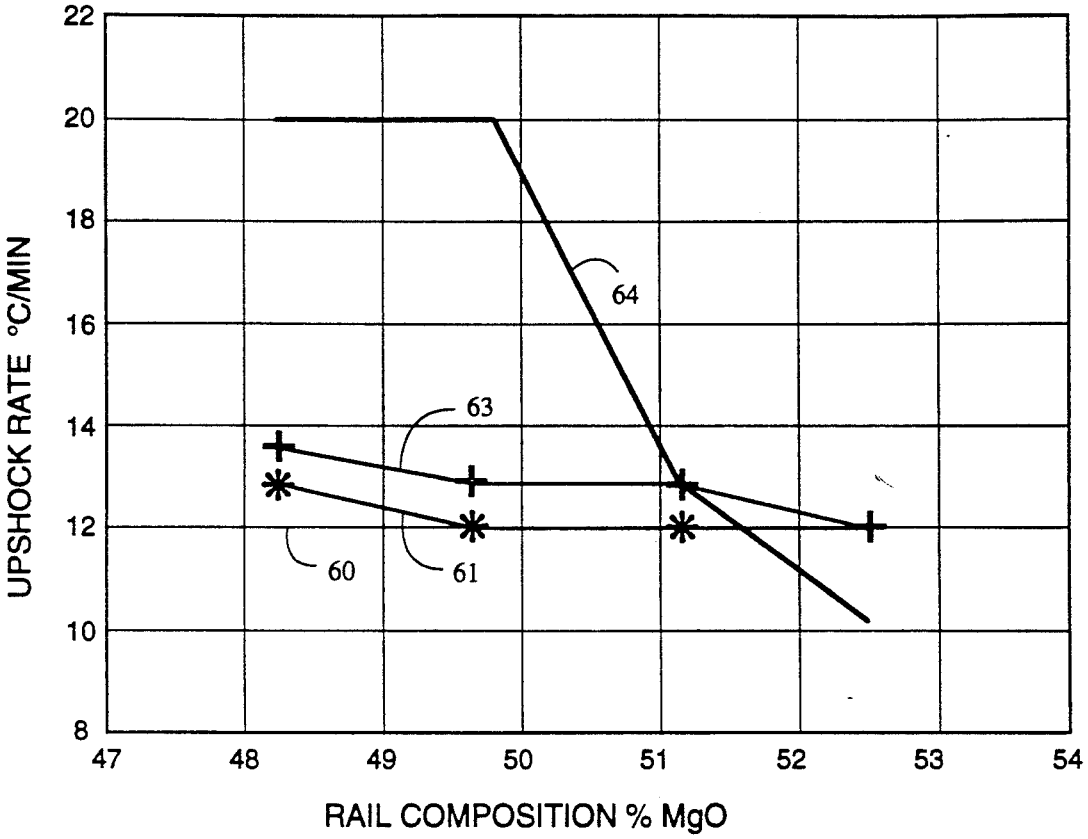
FIG. 9. is a graph showing the exhaust cycle upshock rates for different mask support frame embodiments at varying rail compositions.

As seen in FIG. 9, a graph based on limited empirical studies for the various ceramic rail embodiments having different magnesium oxide rail compositions generally verifies that an increased gap between the actual corner 35 of the mask support frame 12 and the funnel corner 29 results in faster tube evacuation rates.

Briefly, the percentage of magnesium oxide in a ceramic rail composition is inversely proportional to the amount of compression the rail will induce into the panel glass surface surrounding the rail end. For a more complete explanation the reader is referred to U.S. patent application Ser. No. 458,1229, Filed Dec. 28, 1989, commonly owned herewith.

Figure 10:
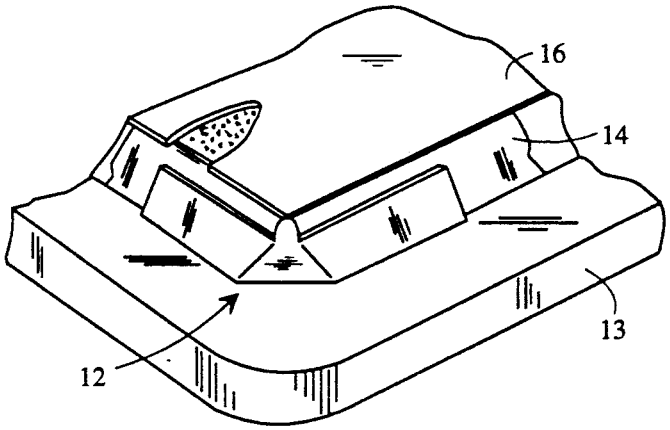
FIG. 10. illustrates the present flat tension mask rail frame embodiment used by the assignee hereof.

With the closed corner ceramic rail frame 12 of FIG. 4, the envelope fails consistently at 10° C./min upshock rate. The chamfered corner metal rail as seen in FIG. 10 and currently used in production, is disclosed in the previously cited 5,053,674 patent. This design has an actual corner to funnel distance of 0.180 inches. The metal frames are filled with a frit of 99×10.7 in/in/° C. coefficient of thermal contraction (CTC). This rail frame design will fail the envelope at about 12.0° C./min. upshock rate and establishes the baseline for improved through-put.

The chamfered/closed corner of FIG. 6, graph line 61, moves the actual corner-to-funnel frit bead gap up to 0.280 inches and results in a 0.9° C./min upshock improvement i.e. from 12° C./min, to 12.9° C./min for chamfered/closed corners at the lowest magnesium oxide percentage, which is the best prestress condition of the panel skin. A chamfered corner approach also gains some of the upshock rate improvement due to elimination of the sharp corner of the square corner system (FIG. 4) which is a more severe stress concentrator.

The three-eights inch gap corner, represented in FIG. 9 at line 63 and illustrated in FIG. 5 has an actual corne to funnel spacing of 0.325 inches and runs from 13.5° C./min at low magnesium oxide rail composition, to 12.9° C./min at the two mid-range magnesia rail compositions, to 12° C./min at the high magnesium oxide rail composition. A gain in upshock rate from this three-eights inch corner gap, over that of a chamfered corner metal rail frame is realized for all but the slightly-tensil high magnesium oxide panel skin prestress condition. Thus panel skin prestress is seen as an important contributing factor to the present invention with current materials.

The one and three-eights inch gap corner, represented in FIG. 9 by line 64 and illustrated in FIG. 7, exhibits a dramatic increase in upshock rates, 20° C./min with envelope failure occurring due to noncorner stress related factors, for the two highest prestress rail compositions. This combination of compressive skin stress and maximum withdrawal of rails from the funnel corner, essentially eliminates stress concentrators at the critical funnel corner seal area. However, the failure rate drops to 12.9° C./min, equal with the three-eights inch gap at the lower panel-skin compressive prestress.

It will therefore be seen that by appropriately prestressing the panel skin at the mask support rail frame corners where the stress concentrators lie, and by adjusting the locations of the stress concentrators away from the critical funnel seal corner area, CRT throughput may be increased during the exhaust cycle, thus providing economies in the manufacturing process. As panel size and thickness increase the actual corner-to-funnel frit bead distance should increase.

While the present invention has been illustrated and described in connection with the preferred embodiments, it is not to be limited to the particular structure shown, because many variations thereof will be evident to one skilled in the art and are intended to be encompassed in the present invention as set forth in the following claims:

Having thus described the invention, what is claimed is:

1. A method of obtaining an accelerated upshock rate in the exhaust cycle of a particular screen size model of a tension mask cathode ray tube (CRT) envelope having fixed screen and front paneldimensions, the envelope components including;

a substantially rectangular glass front panel with a substantially rectangular tension mask-supporting frame sealed thereto and a funnel with a substantially rectangular funnel seal land, also sealed to the front panel; the method comprising:

retaining the fixed dimensions of the envelope components, and increasing the spacing of an actual corner of the mask support frame away from a funnel seal corner, the spacing being consistent with the desired accelerated upshock rate.

2. The method of claim 1 further including the step of:

providing the mask support frame as a closed ceramic frame with chamfered corners.

3. The method of claim 2 further comprising providing the chamfered corners as discrete pieces of the frame.

4. The method of claim 2 further including the step of:

withdrawing the actual corner of the closed frame from the funnel corner by at least substantially 0.280 inches.

5. The method of claim 2 further including the step of:

withdrawing the actual corner of the closed frame from the funnel corner by greater than 0.180 inches.

6. The method of claim 1 further including the step of:

providing the mask support frame as an open frame comprising discrete rails arranged with adjacent ends of substantially perpendicular ones of the discrete rails withdrawn from the virtual corner.

7. The method of claim 6 further including:

withdrawing the rails to provide an actual corner to funnel seal distance of at least substantially 0.325 inches.

8. The method of claim 6 further including the step of:

withdrawing the adjacent ends of the substantially perpendicular ones of the discrete rails to provide an actual corner to funnel seal distance of at least substantially 1.10 inches.

9. The method of claim 1 further including the step of providing compressive stress in the skin of the front panel adjacent the mask supporting frame corners, the compressive stress being present subsequent to sealing the frame to the panel.

10. A method of obtaining an accelerated upshock rate in the exhaust cycle of a tension mask cathode ray tube (CRT) envelope model having fixed outside dimensions and envelope components including a substantially rectangular glass front panel, with a substantially rectangular tensioned shadow mask-supporting rail frame and a funnel with a substantially rectangular seal land both sealed to the panel, and all of fixed dimensions; comprising:

a) establishing a baseline thermal upshock rate for the envelope model having a rectangular, closed rail frame wherein the actual and virtual rail frame corners are the same;

b) determining a desired accelerated upshock rate for the envelope model, c) retaining the known dimensions of the envelope components; and d) withdrawing the actual corners of the rail frame from the virtual corners to increase the separation distance from the rail frame actual corner to the funnel seal corner of the envelope model, the withdrawal being consistent with the desired accelerated upshock rates; thereby allowing the envelope model to be exhausted at the accelerated upshock rate.

11. The method of claim 8 wherein the accelerated upshock rate is greater than 12.0° C./min.

12. A CRT envelope having a substantially rectangular glass flat panel of known dimension, the panel being sealed to a CRT funnel having a substantially rectangular funnel seal land, and the panel having a substantially rectangular tension mask-supporting rail frame also sealed thereto, comprising:

a mask support rail frame having an actual corner spaced a predetermined distance apart from a funnel seal corner, the predetermined distance being greater than the distance of a corresponding virtual corner of the rail frame from the funnel seal corner, and wherein the mask support frame is composed substantially of ceramic material and has chamfered corners, thereby allowing the envelope model to be exhausted at the accelerated upshock rate.

13. A CRT envelope having a substantially rectangular glass flat panel of known dimension, the panel being sealed to a CRT funnel having a substantially rectangular funnel seal land, and the panel having a substantially rectangular tension mask-supporting frame also sealed thereto, comprising:

a mask support frame having an actual corner spaced a predetermined distance apart from a funnel seal corner; and, the rail frame comprising four discrete rails, one for each side of the substantially rectangular frame, with adjacent ends of substantially perpendicular ones of the discrete rails withdrawn from the virtual corner, and in which, the rail ends are withdrawn to provide an actual corner to funnel seal corner distance of at least substantially 0.325 inches.

14. The CRT envelope of claim 13 wherein the actual corner to funnel seal distance is greater than 0.325 inches.

15. The CRT envelope of claim 13 wherein the panel skin adjacent the glass is in compression subsequent to affixation of the rail frame.

16. A method of obtaining an accelerated upshock rate in the exhaust cycle of a tension mask cathode ray tube (CRT) envelope having components of known dimensions, the components including a substantially rectangular glass front panel with a substantially rectangular tension mask-supporting frame sealed thereto and a funnel with a substantially rectangular funnel seal land, also sealed to the front panel; comprising:

a) selecting rails having a CTC less that the panel glass, b) attaching the rails to the front panel such that the panel surface is put into compression adjacent the rail ends, c) separating the rail end frit beads from the funnel corner frit bead location by a distance consistent with the desired accelerated upshock rate, d) affixing a funnel to the panel, and e) evacuating the CRT envelope at the desired accelerated up shock rate.

* * * * *